United States Patent [19]

Miller et al.

[11] 4,121,013

[45] Oct. 17, 1978

[54] RECORD MATERIAL

[75] Inventors: Robert E. Miller; Bruce W. Brockett, both of Appleton, Wis.

[73] Assignee: NCR Corporation, Dayton, Ohio

[21] Appl. No.: 789,384

[22] Filed: Apr. 21, 1977

Related U.S. Application Data

[62] Division of Ser. No. 570,051, Apr. 28, 1975, Pat. No. 4,022,936.

[51] Int. Cl.[2] ..... B41L 1/20; E05A 3/48

[52] U.S. Cl. ..... 428/411; 106/21; 282/27.5; 427/145; 427/399; 427/150; 428/420; 428/539; 428/537

[58] Field of Search ..... 427/145, 399, 150; 106/21; 282/27.5; 428/411, 537, 420, 539; 116/114 AM

[56] References Cited

U.S. PATENT DOCUMENTS

| | | | |
|---|---|---|---|
| 3,843,383 | 10/1974 | Ishige et al. | 427/145 |
| 3,896,255 | 7/1975 | Kato et al. | 427/145 |
| 3,934,070 | 1/1976 | Kimura et al. | 428/411 |
| 3,983,292 | 9/1976 | Saito et al. | 428/537 |

*Primary Examiner*—William A. Powell
*Assistant Examiner*—J. J. Gallagher
*Attorney, Agent, or Firm*—J. T. Cavender; E. Frank McKinney

[57] ABSTRACT

A sensitized record sheet material is disclosed, suitable for developing color in oily, colorless, chromogenic dye-precursor inks applied thereto. Said record sheet material has a light, reactive, coating which comprises a zinc compound and a salicylic acid derivative combinded in, and applied from, an aqueous system of basic pH. The coating composition is also disclosed, as is the process for making it.

11 Claims, No Drawings

RECORD MATERIAL

This is a division of application Ser. No. 570,051, filed Apr. 28, 1975 now U.S. Pat. No. 4,022,936.

BACKGROUND OF THE INVENTION

1. Field of the Invention

This invention relates to sensitized record sheet material useful in developing dark-colored marks on contact with colorless ink solutions of chromogenic dye-precursor materials. Such sheet material generally includes an acidic material in the form of a coating on at least one sheet surface. The coating of acidic material serves as a receiving surface for colorless, liquid, solutions of chromogenic compounds which react, on contact, to produce the dark-colored marks.

Acidic materials for use in these record sheet materials have, in the past, included acid or active clay compounds and phenolic resin materials. This invention relates to improved record sheet materials in which neither active clay nor phenolic resin are used.

This invention more particularly relates to the record sheet material coating and to the coating composition. This invention particularly pertains to effective coating compositions used in reduced amounts, without active clay components, and to such coating compositions having an aqueous vehicle at a pH above neutral.

Still more particularly, this invention relates to such coatings from a formulation which includes an aqueous, basic, dispersion of a hydroxy-substituted aromatic carboxylic acid derivative and a Group II metal oxide, carbonate, or phosphate.

This invention, even more specifically, pertains to aqueous, basic, coating formulations, without active clay components, wherein ammonium hydroxide is used to maintain a basic pH, wherein the carboxylic acid derivative is substituted salicylic acid and wherein the metal is zinc. This invention also relates to a record sheet material made using this coating formulation and to the process for making it.

2. Description of the Prior Art

Sensitized record sheet materials are generally known in the prior art. U.S. Pat. No. 3,723,156, issued Mar. 27, 1973, discloses a sensitized record sheet for use with chromogenic compounds wherein the record sheet coating includes an oil-soluble metal salt and an oil-soluble phenolic resin. In the sheet of that patent, there is disclosed to be synergism which results from combination of the metal salt and the phenolic resin. A metal salt disclosed therein, to give some degree of color development, is zinc salicylate.

U.S. Pat. No. 3,767,449, issued Oct. 23, 1973, discloses a sensitized record sheet such as zinc oxide and a carboxylic acid-aldehyde polymer material. Salicylic acid is disclosed to be an eligible carboxylic acid and there is said to be a synergism between the components. The coating is applied from organic solvent systems and in large amounts to yield heavy coatings.

Japanese Disclosure No. Sho 48-51712, dated July 20, 1973, discloses a sensitized sheet wherein the coated components are salicylic acid derivatives combined with zinc or other metal oxide and coated from an aqueous system. The coating weight is high and there is specific teaching that the pH of the coating system must be less than 7.0.

U.S. Pat. No. 3,843,383, issued Oct. 22, 1974, discloses a color developing sheet using an active clay and an aromatic carboxylic acid or alkali metal salt thereof. The sheet of that patent is required to have an active clay which serves as the color developing material and is required to have an aromatic carboxylic acid which apparently serves to stabilize the color, once developed.

SUMMARY OF THE INVENTION

For reasons of economy and product acceptability, it has long been an aim, in the manufacture of receiving sheets, to use a minimum amount of coating material and yet develop the darkest possible mark on ink reaction.

Also important among desirable receiving sheet qualities is stability to contact with the environment, both before and after marking. Before marking with chromogenic ink, the receiving sheet coating should maintain its color developing capacity without being desensitized or discolored by reaction or contact with the ambient atmosphere and light radiation. After marking with chromogenic ink, the reacted portions of receiving sheet coating should be such as to prevent color fade or shift in hue, insofar as is possible. Such stability of marks is aided by using stable coating components relatively unaffected by outside influences, once reacted with a chromogenic material.

It is highly desirable that the dark-colored reaction product should form quickly after contact between the coating and the chromogenic material. The quick formation of colored reaction product is seen as speed of print development when used in the sensitized receiving sheet arts; and speed of print development is increased by using coating components of increased reactivity. Care must be exercised not to lose stability in using more reactive components In manufacturing the receiving sheets, economical operation requires application of the coating composition from an aqueous medium without organic solvents. A coating composition which must include organic solvents is a coating composition expensive to apply and cumbersome to dry. Moreover, in preparing the receiving sheets, it is desirable to utilize alkaline coating conditions for several reasons. Most coatings with inactive clay fillers are alkaline and alkaline coating conditions facilitate the use of, and compatability with, such inactive fillers. Alkaline coating conditions are also believed to improve the stability of the paper and the coating and to improve the adhesion of the coating to the paper.

It is an object of this invention to provide a coated, color-developing, receiving sheet of improved quality and of high density color in developed marks using decreased amounts of coating material and without using active clay materials.

It is an additional object of this invention to provide a coated, color-developing, receiving sheet of improved stability and rapid speed of print development.

It is an additional object of this invention to provide a coating composition useful in manufacturing coated, color-developing, receiving sheets which composition is aqueous and does not use active clay or organic solvents or vehicles.

The coating composition of this invention is specific in several aspects. In those aspects which are disclosed to be critical, there is very little margin for modification. There is a synergism of response amongst the several critical elements; and, to alter one element, alters the synergistic effect. The system, disclosed, represents a combination of several critical aspects to yield a community of properties improved over the prior art.

Development of the present invention commenced from a requirement to prepare improved record sheet receiving material using less active coating material than was previously used and using only an aqueous vehicle for the coating composition. The coating composition which was found and which is disclosed herein satisfies the initial requirements and comprises, as active materials, a hydroxy-substituted aromatic carboxylic acid derivative and a zinc compound. Moreover, the aqueous vehicle must have a controlled and maintained pH above about 7.5 and below about 10.0, preferably, between about 8.0 and 9.8. It is not understood what reaction, if any, occurs between the active material components at the required pH. Ammonium hydroxide is used to control and maintain the pH. Of course, ammonia gas is equivalent to ammonium hydroxide in pH control of the coating composition.

The hydroxy-substituted aromatic carboxylic acid is a salicylic acid derivative and is generally, additionally, substituted by relatively bulky moieties such as aryl, isopropyl, sec- and tert-butyl, sec- and tert-amyl, and the like. Substitution at the 3,5 positions is preferred, and preferred compounds are 3,5-diisopropyl salicylic acid, 3,5-di-tert-butylsalicylic acid, and 3-tert-butyl-5-methyl salicylic acid. The 3,5-di-tert-butylsalicylic acid is most preferred.

The zinc compound is an oxide, carbonate, phosphate, or phenolsulfonate.

The composition used in coating the record sheets of this invention is prepared, for example, by dispersing the salicylic acid derivative and the zinc compound in water, in finely divided form, until both materials are completely wetted and then adding ammonium hydroxide. If desired or required in any particular case, a dispersing agent can be added to the system to facilitate the particle wetting step. For preparation of the composition, the amount of water present at the time of ammonium hydroxide addition is unimportant.

Adhesives, binders, pigments, fillers and whatever other additional materials are desired or required can then be added to the system. Any additional materials can be added to achieve any incidental effect in the sensitized record sheets. It is only required that the additional materials be substantially inert with respect to reaction with the color-developing components and that the additional materials do not render the system pH difficult to control. Such additional materials are termed inactive materials and are separate and distinct from active materials and play no part in color developing reactions. Except with regard to the above requirements, the kind and amount of additional material is not critical. Adhesives or binders such as soluble starch, poly(vinyl alcohol), or latex can be used; and pigments such as calcium carbonates, inactive clay or titanium dioxide can be added for tinting or opacification. Other additional materials might include defoaming agents, viscosity modifiers, lubricants, preservatives, and the like.

The dispersion of salicylic acid derivatives, zinc compound, ammonium pH-adjusting compound, and whatever additional materials is coated onto a substrate sheet or the dispersion is combined into or with the sheet during sheet manufacture. The concentrations of solid materials in the dispersion is not critical and is unimportant except insofar as a high solids concentration might cause an excessive viscosity. The dispersion can be applied to already made substrate sheets by means of a coating device such as a wire-wound rod, an air knife, trailing blade, or a flexographic press. For such a coating application, the dispersion is generally about 15 to 60 weight percent solids with about 2.5 to 20 weight percent of the solids being active materials;—salicylic acid derivative and zinc compound materials. The dispersion can also be applied to a moving web of paper either on a paper making machine or not. Such an application can be made, for example, at the size press or on the wire of a paper making machine; and the dispersion, for that application, is generally about 35 to 50 weight percent solids with about 2.5 to 20 weight percent of the solids being active materials;—generally about 1–6 percent of the active materials being salicylic acid derivative. If the application is made, for example, at the head box of a paper making machine, percentage of solid materials is completely unimportant so long as the salicylic acid derivative and the metal oxide have been previously, properly, combined in the presence of the ammonium pH-adjusting material.

In the past, organic acid derivative color developers have been used in amounts of at least 0.6 to 1.3 grams per square meter of coating. A remarkable benefit of the coating composition of this invention is that maximum marking qualities result from a low coating weight. Coating weights of salicylic acid derivative as low as about 0.10 to 0.40 grams per square meter provide a completely acceptable sheet. The quality of the sheet, in regard to marking, is slightly improved by increased coating amounts;—a most preferred range for coat weight of salicylic acid derivative used herein being about 0.15 to about 0.30 grams per square meter. Above about 0.4 grams per square meter, there is slight improvement with increased coat weight.

Active material coat weight considerations must always include evaluation of the relative amounts of salicylic acid derivative and zinc compound. In all cases, and regardless of the point or method of coating application, the salicylic acid derivative and zinc compound materials are present in a weight ratio of about 1:1 to 1:6 and, preferably, about 1:2 to 1:4, respectively.

All designations of percent, which follow, refer to percent, by weight, unless specified otherwise.

The coated substrate is dried and calendered, if such is desired, and is then ready for use as the record sheet of this invention. The sensitized record sheet can be used in conjunction with sheets coated on one side by microcapsules containing a liquid solution of chromogenic material, or, after the calendering step, the sensitized record sheet itself can be coated, on the same or another surface, by such microcapsules. Of course, the sensitized record sheet can also be marked directly by a colorable ink comprising chromogenic materials.

Chromogenic compounds which are eligible for use with the sensitized record sheet, herein, are well-known and include, generally, phthalides, fluorans, leucauramines, acyl auramines, and the like;—a listing of exemplary chromogenic compounds being presented in U.S. Pat. No. 3,672,935.

All ratios, compositional parts, or percent composition figures herein are parts, by weight, or weight percents, unless otherwise indicated.

DESCRIPTION OF THE PREFERRED EMBODIMENTS

EXAMPLE 1

In this example, a coating composition is prepared for use in manufacturing the sensitized record sheet of this invention. The active components are 3,5-di-tert-butylsalicyclic acid, zinc oxide and ammonium hydroxide.

As a first step, the active materials, that is, the salicylic acid derivative, the zinc compound and the ammonium hydroxide, are combined. The composition is then completed by adding whatever fillers, inactive pigments, and binders are required or desired.

About 10 parts of salicylic acid derivative—in this Example, 3,5-di-t-butylsalicylic acid—and about 30 parts of zinc compound—in this Example zinc oxide—are dispersed together in about 210 parts of water. A few parts of a dispersing agent can be used, if desired. About 16 parts of aqueous ammonium hydroxide solution (28–30 weight percent $NH_3$) is added to the combination with agitation. For best results, the system is permitted to stand for about 16 hours.

About 70 parts of that dispersion is added to about 210 parts of 35 percent inactive kaolin clay in water and thoroughly mixed. To that mixture is added 100 parts of 10 percent, aqueous, cooked starch binder and 12 parts of 50 percent, aqueous, styrene-butadiene latex binder. The clay, the starch, and the latex are inactive materials and do not serve functional purposes insofar as the record sheet sensitivity is concerned. The clay is used as a filler material and the starch and latex are binder materials. The amount of any of those components is not critical and can be varied to a large extent. The filler materials are used as a matter of coating convenience and an improved and operable sheet is made if those materials are omitted altogether.

In the first step, after addition of the ammonium hydroxide, the pH of the dispersion is above 8.0. After the inactive clay and all of the other, additional, materials are combined, the pH is about 9.6.

For testing purposes, the formulation is coated onto sheets to achieve a dry coating weight of about 7.5 grams per square meter.

When a sheet is made with only binders and active material and without inactive clay and other inactive filler pigments, the coating weight is only about 2.3 grams per square meter.

EXAMPLE 1(a)

Here will be described a capsule-coated transfer sheet for use in testing the receiving sheets prepared in examples which follow. The capsules contain a liquid solution of chromogenic material and are prepared as follows: An aqueous emulsion having oil droplets of 2 to 3 microns diameter is prepared by mixing the following materials at 55 degrees centigrade. (All water used herein is deionized water.)

200 grams of the selected capsule contents
200 grams of 10 percent aqueous gelatin solution
50 grams of water With continual stirring and maintenance of the temperature at 55° C., the pH of the stirred emulsion is adjusted to 6.5, and the emulsion is treated with 133 grams of 10 percent aqueous gum arabic solution and then diluted with 700 grams of water.

The stirred mixture is then treated with 12 grams of 5 percent aqueous poly(methylvinylether-co-maleic anhydride) solution, added dropwise. About 15 milliliters of 14 percent acetic acid are added to adjust the pH to about 4.5. With continued stirring, the mixture is cooled to about 15° C., treated with 10 milliliters of 25 percent aqueous glutaraldehyde and allowed to stir at room temperature for about 48 hours. An aqueous slurry of the capsules is made up having the following composition:

| | Parts | |
|---|---|---|
| | (Wet) | (Dry) |
| Capsules | 485 | 100 |
| Arrowroot starch granules | 24 | 24 |
| Cooked cornstarch | 50 | 10 |
| Water | 41 | — |

Paper sheets are coated with the above slurry with a No. 15 Mayer rod to give a dried coating weight of about 4.5 grams per square meter.

For this Example 1(*a*) transfer sheet, the capsule contents include a solution mixture of substantially water insoluble liquids dissolving a mixture of four chromogenic materials. The liquids are about 60 percent of ethyl diphenyl methane, 30 percent of a saturated hydrocarbon oil with a distillation range of about 190°–250° C., and 10 percent of heptyl undecyl phthalate. The chromogenic materials are dissolved in the liquid in total amount of about 3.3 percent of the liquid. The chromogenic materials are about 1.70 percent of crystal violet lactone, 0.50 percent of benzoyl leuco methylene blue, 0.55 percent of 2'-anilino-6'-diethylamino-3'-methyl fluoran, and 0.55 percent of 3,3-bis(1-ethyl-2-methylindol-3-yl)phthalide.

The dried capsule coating is made to be about 3.0–3.7 grams per square meter.

FORMULATION COMPARISONS

The formulations of the following Examples are tested against the transfer sheets of Example 1(a). A capsule coated sheet surface is placed against a receiving sheet surface from the examples and the capsule coated sheet is struck in an image pattern using an electric typewriter. The capsules are ruptured and a colored image is formed where the released chromogenic materials contact the receiving sheet coating. The resulting pattern images are tested for print intensity by use of a reflectance spectrophotometer (opacimeter). Typewriter intensity indexes are reported here for the receiving sheets described in Examples 1–6. A typewriter intensity index (TI) of 100 indicates no detectable print and the lower numbers indicate more intense prints, showing greater contrast with the background. Generally, a typewriter intensity index of less than 60, for a black print, indicates a print which is sufficiently intense to be esthetically pleasing and readily read by the human eye.

InitiaL typewriter intensity is designated as (ITI). The typewriter intensity of a mark after aging 24 hours is designated as (ATI). A mark exposed for 24 hours to ultraviolet radiation is designated as (UVTI). A mark made using a receiving sheet which has been exposed for 24 hours to ultraviolet light before marking is designated as (UV Sheet).

To commence the comparisons, the sheets of Example 1, which is the preferred sheet of this invention, exhibited the following values:

| Example | ITI | ATI | UVTI | UV Sheet |
|---|---|---|---|---|
| 1 | 56 | 56 | 78 | 62 |

EXAMPLE 2

The same formulation is made in this example as was described in Example 1 with the exception that the salicylic acid derivative is 3,5-di-iso-propylsalicylic acid. The pH of the final composition is 8.9.

When no salicylic acid derivative is used the pH of the final composition is 10.1; and when unsubstituted salicylic acid is used the pH is 7.1 (Designated as Example 2(a)).

| Example | ITI | ATI | UVTI | UV Sheet |
|---|---|---|---|---|
| 1 | 56 | 56 | 78 | 62 |
| 2 | 63 | 57 | 76 | 84 |
| 2(a) | 85 | 83 | 92 | 90 |

The use of 3-tert-butyl-5-methyl salicylic acid provides results comparable to those of 2. Increasing the pH when using unsubstituted salicylic acid does not appreciably alter the results of 2(a).

EXAMPLE 3

The same formulation is made in this example as was described in Example 1 with the exception that sodium hydroxide is substituted for the ammonium hydroxide. The pH of the final coating composition is adjusted to be about 9.8.

| Example | ITI | ATI | UVTI | UV Sheet |
|---|---|---|---|---|
| 1 | 56 | 56 | 78 | 62 |
| 3 | 79 | 68 | 89 | 88 |

Sodium hydroxide is an unacceptable pH adjusting material. Similar results are obtained from potassium hydroxide. It is believed that ammonium hydroxide is especially suited for the coating system of this example because it is volatile and it is removed when the coating is dried.

EXAMPLE 4

The same formulation is made in this example as was described in Example 1 with the exception that, for purposes of the test, twice the amount of zinc oxide was used (60 parts of this example) and a varying amount of ammonium hydroxide was used.

The varying amounts of ammonium hydroxide and the coating system pH, are designated as follows, along with the test results.

| Example | Parts $NH_4OH$ | pH | ITI | ATI | UVTI | UV Sheet |
|---|---|---|---|---|---|---|
| 1 | 16 | 9.6 | 56 | 56 | 78 | 62 |
| 4(a) | 0 | 7.2 | 83 | 78 | 90 | 85 |
| 4(b) | 4 | 8.2 | 71 | 64 | 84 | 71 |
| 4(c) | 8 | 8.7 | 56 | 56 | 77 | 62 |
| 4(d) | 12 | 9.3 | 60 | 58 | 82 | 66 |
| 4(e) | 16 | 9.6 | 59 | 58 | 79 | 62 |
| 4(f) | 20 | 9.8 | 59 | 59 | 82 | 64 |

Note that Examples 4(c), 4(d) and 4(e) yield very good results and that Examples 4(b) and 4(f) yield results which are acceptable.

EXAMPLE 5

The same formulation is made in this example as was described in Example 1 with the exception that, for purposes of the test, a varying amount of 3,5-di-tert-butylsalicylic acid is used.

The varying amounts of salicylic acid derivative, and the resulting coating system pH, are designated as follows:

| Example | Parts Salicylic Acid Derivative | pH | ITI | ATI | UVTI | UV Sheet |
|---|---|---|---|---|---|---|
| 1 | 10 | 9.6 | 56 | 56 | 78 | 62 |
| 5(a) | 0 | 10.1 | 89 | 88 | 93 | 90 |
| 5(b) | 4 | 9.7 | 73 | 70 | 88 | 83 |
| 5(c) | 10 | 9.6 | 59 | 58 | 79 | 62 |
| 5(d) | 16 | 9.3 | 55 | 56 | 74 | 61 |
| 5(e) | 22 | 8.8 | 55 | 56 | 73 | 59 |

EXAMPLE 6

The same formulation is made in this example as was described in Example 1 with the exception that, for purposes of the test, a varying amount of zinc oxide is used. The pH for the resulting coating system is constant within a narrow range of about 9.4 to 9.6.

The varying amounts of zinc oxide, and the resulting weight ratio of zinc compound to salicylic acid derivative are designated as follows:

| Example | Parts Zinc Compound | Ratio of Zinc Compound to Salicylic Acid Derivative | ITI | ATI | UVTI | UV Sheet |
|---|---|---|---|---|---|---|
| 1 | 30 | 3 | 56 | 56 | 78 | 62 |
| 6(a) | 0 | — | 72 | 72 | 91 | 91 |
| 6(b) | 10 | 1 | 60 | 61 | 83 | 66 |
| 6(c) | 20 | 2 | 60 | 59 | 82 | 68 |
| 6(d) | Example 1, repeated | | 56 | 56 | 78 | 62 |
| 6(e) | 40 | 4 | 59 | 58 | 80 | 62 |
| 6(f) | 50 | 5 | 58 | 59 | — | — |
| 6(g) | 60 | 6 | 59 | 58 | 79 | 62 |

EXAMPLE 7

In the test of this example, a capsule transfer sheet is used which has capsules in an amount, and of a size, similar to those of Example 1(a), above. The substantially water insoluble liquid is a 2-to-1 solution mixture of 2,2,4-trimethyl-1,3-pentanediol diisobutyrate and the hydrocarbon oil of Example 1(a).

The same formulation is made in this example as was described in Example 1 with the exception that, for purposes of the test, different zinc compounds are used.

The different zinc compounds are designated as follows:

| Ex. | Zinc Compound | ITI | ATI | UVTI | UV Sheet |
|---|---|---|---|---|---|
| 1 | zinc oxide | 57 | 54 | 64 | 56 |
| 7(a) | zinc phenol sulfonate | 66 | 59 | 71 | 69 |
| 7(b) | zinc carbonate | 60 | 55 | 67 | 56 |
| 7(c) | zinc phosphate | 76 | 66 | 77 | 79 |

While the different zinc compounds do not yield test results as good as the preferred zinc oxide, they are acceptable. Combinations of the zinc compounds can be used. Materials with cations other than zinc are not found to be acceptable for use in this invention.

As an additional matter of comparison, the zinc phenol sulfonate tested against the sheet of Example 1(*a*) yielded the following test results: ITI-58; ATI-58; UVTI-83; and UV Sheet-70.

EXAMPLE 8

In this example, test receiving sheets are prepared using a specially-prepared salicylic acid/formaldehyde polymer in the place of the salicylic acid derivative of Example 1. The polymer is prepared by reacting 138 parts of salicylic acid and 325 parts of formalin in 250 parts of 12 N sulfuric acid at 95° to 97° C for 1 hour. Twenty parts of the resulting polymer are combined with 300 parts of ethanol and 100 parts of one of three, below-identified metallic compounds. This formulation is applied to sheets to yield coatings of about 5–6 grams per square meter.

The above receiving sheet coatings are tested against the transfer sheet of Example 1(a) and the results are compared with the test results of the receiving sheet of Example 1, herein. The sheets of this Example 8 contain more than seven times as much salicylic acid polymer as there is salicylic acid derivative in the sheets of Example 1. Moreover, the sheets of Example 8 contain more than ten times as much metallic compound.

The different receiving sheets, identified by metallic compound, are set out below. The Typewriter Intensity Indexes are provided for several time periods to show the speed of print development.

| Ex. | Metallic Compound | ITI | 20 minutes | 16 hours | ATI |
|---|---|---|---|---|---|
| 1 | zinc oxide | 56 | — | — | 56 |
| 8(a) | zinc oxide | 84 | 79 | 78 | 76 |
| 8(b) | calcium carbonate | 88 | 81 | 78 | 76 |
| 8(c) | zinc carbonate | 84 | 80 | 76 | 74 |

EXAMPLE 9

The receiving sheet formulations can be applied by several methods, as previously disclosed. In this example, several methods of such application are discussed.

The receiving sheet of this invention can be made by adding components of the formulation of Example 1 at selected positions on a paper making machine. For instance, the zinc compound can be added at the head box and the salicylic acid derivative can be added at a size press on the machine. An appropriate head box formulation is:

| | Parts |
|---|---|
| Hardwood Kraft pulp | 125 |
| Softwood Kraft pulp | 125 |
| alum | 1.25 |
| modified starch (cationic) | 1.75 |
| water soluble rosin | 1.00 |
| Calcium carbonate | 16.7–20.9 |
| Zinc oxide | 4.2–8.4 |
| Acrylamide retention aid | 0.1–0.2 |

Water is added to the pulp with agitation to a consistency of 3.0–3.3 (percent over-dry fiber in water) and this suspension is refined to a Freeness of 340 ± 20 milliliters). Then the alum, rosin and fillers are added, and the pH is adjusted with ammonium hydroxide. Starch and retention aid are finally added.

An appropriate size press formulation is:

| | |
|---|---|
| Starch gum | 4 parts |
| 3.5-di-tert-butyl salicylic acid | 2.5–5.0 |
| ammonium hydroxide (28%) | 1–2 |
| water | 90 |

Sheets made using the above head box formulation and coated at the size press yield test results comparable to the sheets of Example 1. Analysis of the coating, as applied above, shows that the salicylic acid derivative is present at 0.2 to 0.4 grams per square meter and that zinc oxide is present at 1.0 to 1.8 grams per square meter.

Alternatively, the entire receiving sheet formulation can be built into the web at the head box or can be added to the web at a size press. For either alternative, care must be exercised to assure that the ratio of salicylic acid derivative to zinc compound is within the previously described ranges.

An increased amount of active materials is required in the head box application to make up for loss of materials through the web, during web formation. The size press formulation may require an additional amount of adhesive binder.

As another alternative, the coating formulation of Example 1 can be applied onto a moving paper machine web from a curtain coating apparatus. In such an operation, the formulation is substantially as previously disclosed with the exception that additional water may be used for better control of the coating weight.

What is claimed is:

1. A sensitized record sheet material comprising a substrate and a coating comprising an active material consisting essentially of the dried residue of an aqueous dispersion of a 3,5-substituted salicylic acid, a zinc compound selected from the group consisting of zinc oxide, zinc carbonate, zinc phosphate and zinc phenol sulfonate, and ammonium hydroxide at a pH of 7.5 to 10.0, wherein the 3,5'substituted salicylic acid is present in an amount of 0.1 to 0.4 grams per square meter and the 3,5-substituted salicylic acid and the zinc compound are present in a weight ratio of 1:1 to 1:6.

2. The record sheet material of claim 1 wherein the 3,5-substituted salicylic acid is selected from the group consisting of 3,5-diisopropyl salicylic acid, 3,5-di-tert-butyl salicylic acid, and 3-tert-butyl-5-methyl salicylic acid.

3. The record sheet material of claim 1 wherein the active material is 2.5 to 20 weight percent of the coating.

4. The record sheet material of claim 1 wherein the 3,5-substituted salicylic acid is 3,5-di-tert-butyl salicylic acid and the zinc compound is zinc oxide.

5. A process for making a paper coating composition comprising the steps of:

(a) dispersing into an aqueous liquid vehicle active material consisting essentially of a 3,5-substituted salicylic acid and a zinc compound, selected from the group consisting of zinc oxide, zinc carbonate, zinc phosphate, zinc phenol sulfonate, wherein the 3,5-substituted salicyclic acid and the zinc compound are present in a weight ratio of about 1:1 to 1:6; and (b) adjusting the pH of the dispersion to 7.5 to 10.0 by addition of ammonium hydroxide.

6. The process of claim 1 wherein the 3,5-substituted salicylic acid is selected from the group consisting of 3,5-diisopropyl salicylic acid, 3,5-di-tert-butyl salicylic acid, and 3-tert-butyl-5-methyl salicylic acid.

7. The process of claim 6 wherein the zinc compound is zinc oxide and the 3,5-substituted salicylic acid is 3,5-di-tert-butyl salicylic acid.

8. The process of claim 1 wherein the 3,5-substituted salicylic acid and the zinc compound are present in a weight ratio of from 1:1 to 1:6.

9. A paper coating composition comprising an aqueous liquid vehicle and active material consisting essentially of a 3,5-substituted salicylic acid; a zinc compound selected from the group consisting of zinc oxide, zinc carbonate, zinc phosphate and zinc phenol sulfonate; and ammonium hydroxide in an amount to maintain the pH of the composition at 7.5 to 10.0, wherein the 3,5' substituted salicylic acid and the zinc compound are present in a weight ratio of about 1:1 to 1:6.

10. The composition of claim 9 wherein the active material represents about 2.5 to 20, weight percent, of the composition.

11. The composition of claim 9 wherein the zinc compound is zinc oxide and the 3,5-substituted salicylic acid is 3,5-di-tert-butyl salicylic acid.

* * * * *